US006297840B1

(12) United States Patent
Inana

(10) Patent No.: US 6,297,840 B1
(45) Date of Patent: Oct. 2, 2001

(54) THERMOSENSITIVE COLOR PRINTING METHOD AND THERMOSENSITIVE COLOR PRINTER

(75) Inventor: Katsuya Inana, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/386,510

(22) Filed: Aug. 31, 1999

(30) Foreign Application Priority Data

Sep. 3, 1998 (JP) ..... 10-249552
Sep. 3, 1998 (JP) ..... 10-249553

(51) Int. Cl.[7] ..... B41J 2/32; B41M 5/26; B41M 5/34

(52) U.S. Cl. ..... 347/175

(58) Field of Search ..... 347/175, 172; 400/120.02, 120.03

(56) References Cited

U.S. PATENT DOCUMENTS 5,216,438 * 6/1993 Nakao et al. ..... 347/175

* cited by examiner

*Primary Examiner*—Huan Tran
(74) *Attorney, Agent, or Firm*—Sughrue, Mion, Zinn, Macpeak & Seas, PLLC

(57) ABSTRACT

A thermal head records a first color frame on a first coloring layer of thermosensitive color recording paper while the recording paper is transported in a first direction through between the thermal head and a platen roller. After the first color frame is completely recorded, the first coloring layer is optically fixed, and the recording paper is transported in a second direction reverse to the first direction to return to a print start position where the thermal head starts recording the first color frame. Then, the thermal head starts recording a second color frame from the print start position. While the recording paper is transported in the second direction, the recording paper is heated by the thermal head to an extent that does not have an effect on those coloring layers which are not fixed, so the friction factor between the recording paper and the thermal head comes to be approximately equal in the opposite transporting directions. The recording paper after having three color frames recorded thereon is transported in the second direction while being heated by the thermal head up above a glass transit temperature of its protective layer but below a temperature above which the lowest sensitive coloring layer starts coloring. Thereby, the protective layer is smoothed to improve the glossiness of the recording paper.

17 Claims, 11 Drawing Sheets

THERMOSENSITIVE COLOR PRINTING METHOD AND THERMOSENSITIVE COLOR PRINTER

BACKGROUND OF THE INVENTION

1. Field of the Invention

The present invention relates to a thermosensitive color printing method and a thermosensitive color printer for printing a full-color image on thermosensitive color recording paper in a frame sequential fashion. More particularly, the present invention relates to a thermosensitive color printing method and a thermosensitive color printer which reduce color failures and smooth the surface of the thermosensitive color recording paper after having an image recorded thereon.

2. Background Arts

In a thermosensitive color printer, thermosensitive color recording paper, hereinafter called simply the recording paper, is directly headed by a thermal head that is pressed onto the recording paper while the recording paper is transported. As the recording paper is heated, color dots are developed on the recording paper.

As shown in FIG. 11, the recording paper 10 has a thermosensitive cyan coloring layer 12, a thermosensitive magenta coloring layer 13, and a thermosensitive yellow coloring layer 14 formed atop another on one side of a base material 11. A transparent protective layer 15 is formed atop the thermosensitive coloring layers 12 to 14, for protecting the coloring layer 12 to 14 from scratches or stains. The sequence of forming these three coloring layers 12 to 14 is not limited to that shown in the drawings, and the three coloring layers 12 to 14 have different heat-sensitivities from each other that decrease with the depth or distance of the respective layers from an obverse surface 10*a* of the recording layer 10. Intermediate layers 16 and 17 are formed between these three coloring layers 12 to 14, for adjusting the heat-sensitivities of the respective coloring layers 12 to 14. A back protective layer 18 is formed on the opposite side of the base material 11 from the protective layer 15.

In the recording paper 10 shown in FIG. 11, the cyan coloring layer 12 has the lowest heat-sensitivity and the yellow coloring layer 14 has the highest heat-sensitivity. Accordingly, as shown in FIG. 12, the yellow coloring layer 14 needs the smallest heat energy to develop yellow color, whereas the cyan coloring layer 12 needs the largest heat energy to develop cyan color. Because of the difference in heat-sensitivity between the three coloring layers 12 to 14, it is possible to record three color frames sequentially from the highest sensitive coloring layer to the lower sensitive coloring layer by applying increasing amounts of heat energy to the recording paper 10 from one color after another.

To stop the coloring layer from being developed unnecessarily by the heat energy applied for recording the next color frame, the coloring layer having a color frame recorded thereon is fixed by electromagnetic rays of a specific range before the next color frame is recorded. In the recording paper 10, the magenta coloring layer 13 has an absorption spectrum whose peak wavelength is at about 365 nm, and loses coloring ability when it is exposed to ultraviolet rays of this wavelength range. On the other hand, the yellow coloring layer 14 has an absorption spectrum whose peak wavelength is at about 420 nm, and loses coloring ability when it is exposed to violet visible light of this wavelength range. So the violet visible light of 420 nm is projected onto the recording paper 10 after the yellow frame is recorded, before the magenta frame is recorded. After recording the magenta frame, the ultraviolet rays of 365 nm is projected onto the recording paper 10 to fix the magenta coloring layer 13.

The thermosensitive printer uses a platen driven type paper transport device or a capstan driven type paper transport device. The platen driven type feeds the recording paper by rotating a platen roller, whereas the capstan driven type feeds the recording paper by rotating a capstan roller that is provided besides the platen roller.

The capstan roller must be made of a metal with high accuracy, so it is expensive. In addition, it needs a rubber nip roller as a counterpart. Since the platen roller itself is expensive, the capstan driven type costs more compared to the platen driven type. Moreover, because the thermal head must be pressed onto the recording paper with a certain pressure to achieve a sufficient image quality, the load for feeding the recording paper is relatively large, so color failures are easy to occur when the feeding power of the capstan roller is weak.

In the platen driven type, on the other hand, the recording paper is turned a certain angle around the platen roller to improve the feeding power of the platen roller, so a large margin is necessary between a leading end of the recording paper and an image recording area.

The protective layer 15 is made from a transparent plastic resin material. The protective layer 15 also contains various additives to prevent blocking or the like. Because of the additives, the surface of the protective layer 15 is rough. As well-known in the art, the plastic resin material starts to be softened above a glass transit point or temperature of the main component of the resin material. The glass transit point varies between different resin materials. For example, a thermosensitive color recording paper that has been marketed under a trade name Thermo Auto Chrome Pater A-20 by Fuji Photo Film Co., Ltd., uses PVA (poly-vinyl-alcohol) as the main component of the protective layer, and the glass transit temperature of PVA is about 70° C.

Because different amounts of heat energy are applied to the recording paper for developing different colors, and the protective layer is softened in different degrees by the different heat energies, friction factor between the thermal head and the protective layer of the recording paper varies depending upon which color frame is being recorded. Therefore, color failure is likely to occur in the thermosensitive color printer unless the difference in friction factor between colors is not taken into consideration.

The thermal head has an array of glaze layers formed on an alumina substrate, and a heating element is located at a peak of a semi-cylindrical glaze layer that extends crosswise to the paper transporting direction. Since the heat energy applied to the recording paper for developing colors is so high, the temperature of the protective layer of the heated portion can be still above its glass transit point even after it is moved off the glaze layer. In that case, additives contained in the protective layer, such as an anti-blocking agent, emerge to the obverse surface of the recording paper, providing irregular fine roughness on the obverse surface. The roughness lessens glossiness of the obverse surface, and coarsens the printed image.

To restore the glossiness of the recording paper after having an image recorded thereon, according to a conventional smoothing process, a flat smooth sheet is laid over the recording paper, and the recording paper is squeezed together with the flat smooth sheet through a pair of heating rollers, thereby to hot-press the recording paper.

However, this conventional smoothing process needs a specific smoothing apparatus is necessary in addition to the printer, and laying the flat smooth sheet over the recording paper is labor-consuming. Moreover, because the heating rollers contain heaters therein, it is hard to take fine control of heat energy applied from the heat rollers to the recording paper, although the optimum range of heat energy for obtaining the highest glossiness is narrow and limited.

It may be possible to provide a thermosensitive printer with a second thermal head for smoothing in addition to a thermal head for recording, so as to heat the recording paper uniformly by the second thermal head after three color frames are sequentially recorded by the first thermal head. It is also possible to use the same thermal head for recording and smoothing, for example by uniformly heating the recording paper, after having three color frames recorded thereon, by the same thermal head while transporting the recording paper in the same direction as it is transported during recording.

However, optimum contacting conditions of the heating elements with the protective layer for smoothing are different from those optimum for recording. Therefore, it has been difficult to achieve both adequate coloring quality and highest glossiness by using the same thermal head for recording and smoothing.

SUMMARY OF THE INVENTION

In view of the foregoing, an object of the present invention is to provide a color thermosensitive printing method and a thermosensitive color printer for printing a full-color image on thermosensitive color recording paper in a frame sequential fashion, which is effective to reduce color failures.

Another object of the present invention is to provide a color thermosensitive printing method and a thermosensitive color printer which smooth the surface of the thermosensitive color recording paper adequately by use of the same thermal head as used for recording, while maintaining good coloring quality.

According to the present invention, a thermosensitive color printing method of printing a full-color image in a frame sequential fashion on thermosensitive color recording paper having first, second and third coloring layers formed on atop another on one side of a base material in this order from an obverse surface, the first to third coloring layers developing different colors from each other, and having decreasing heat-sensitivities from the first to the third, is comprised of the steps of:

A. pressing the thermosensitive color recording paper onto the thermal head by a platen roller;

B. transporting the thermosensitive color recording paper in a first direction;

C. driving a thermal head during step B, to record a first color frame on the first coloring layer;

D. projecting electromagnetic rays of a specific wavelength range onto the thermosensitive recording paper to fix the first coloring layer after having the first color frame recorded thereon;

E. transporting the thermosensitive color recording paper in a second direction reverse to the first direction after the first color frame is completely recorded till the thermosensitive color recording paper is returned to a print start position where the thermal head started recording the first color frame;

F. driving the thermal head during step E, to heat the thermosensitive color recording paper to an extent that the second and third coloring layers do not develop color;

G. transporting the thermosensitive color recording paper in the first direction after the thermosensitive color recording paper reaches the print start position;

H. driving the thermal head during step G, to record a second color frame on the second coloring layer;

I. projecting electromagnetic rays of a specific wavelength range onto the thermosensitive recording paper to fix the second coloring layer after having the second color frame recorded thereon;

J. transporting the thermosensitive color recording paper in the second direction after the second color frame is completely recorded, to return the thermosensitive color recording paper to the print start position;

K. driving the thermal head during step J, to heat the thermosensitive color recording paper to an extent that the third coloring layer does not develop color;

L. transporting the thermosensitive color recording paper in the first direction after the thermosensitive color recording paper reaches the print start position; and M. driving the thermal head during step L, to record a third color frame on the third coloring layer.

According to a preferred embodiment, the thermal head is driven in step F or K on the basis of image data used for driving the thermal head in step C or H respectively. More preferably, all heating elements of the thermal head are equally heated in step F or K such that a total amount of heat energy applied during step F or K is equivalent to a total amount of heat energy applied during step C or H respectively.

Because the thermosensitive color recording paper is heated up to an approximately same degree in either transporting direction, friction factor between the recording paper and the thermal head comes to be approximately equal in opposite transporting directions. Therefore, it becomes easy to return the recording paper precisely to the print start position without any specific device.

To smooth a plastic protective layer that is formed on the first coloring layer to coat the obverse surface of the thermosensitive color recording paper, according to a thermosensitive color printing method of the present invention, the thermosensitive color recording paper is transported through between the thermal head and the platen roller in the second direction after the first to third color frames are completely recorded, while the thermal head is driven to heat the thermosensitive color recording paper to an extent that the third coloring layer does not develop color. It is preferable for smoothing the protective layer to heat all the heating elements of the thermal head equally up above a glass transit temperature of the protective layer but below a temperature above which the third coloring layer starts coloring.

A thermosensitive color printer of the present invention is comprised of a thermal head having a plurality of heating elements arranged in an array; a platen roller located in opposition to the heating elements of the thermal head so as to press the thermosensitive color recording paper onto the heating elements; a paper transporting device for transporting the thermosensitive color recording paper through between the thermal head and the platen roller in a first direction perpendicular to the array of the heating elements, and alternately in a second direction reverse to the first direction, the paper transporting device transporting the thermosensitive color recording paper three times in either direction per one full-color image; a head driving device for driving the thermal head to record first, second and third color frames sequentially from the first to third respectively while the thermosensitive color recording paper is transported in the first direction for the first time, for the second time and for the third time; and first and second optical fixing devices disposed downstream from the thermal head in the first direction, for fixing first and second coloring layers respectively after the first and second color frames are recorded thereon; wherein the head driving device drives the thermal head also while the thermosensitive color recording paper is transported in the second direction, to heat the thermosensitive color recording paper to an extent that does not have an effect on those coloring layers which are not fixed.

According to a preferred embodiment, the heating elements of the thermal head are formed along a peak of a semi-cylindrical glaze layer, whereas a contact point of the platen roller with the glaze layer is offset upstream from the peak of the glaze layer in the first direction. According to this configuration, the thermosensitive color recording paper comes to contact the glaze layer over a narrower range after the heating element in the first direction, than it contacts the glaze layer before the heating elements in the first direction. Since the recording paper is not cooled so rapidly after the recording, this configuration is effective to prevent unexpected variations in coloring density that would be caused when the recording paper is rapidly cooled after the recording.

While the recording paper is transported in the second direction, on the other hand, the recording paper comes to contact the glaze layer over a wider range downstream from the heating element compared to an upstream contact range of the thermosensitive color recording paper with the glaze layer in the second direction. Therefore, the protective layer is cooled quickly down below its glass transit point while being contacted with the glaze layer, so the adhesives contained in the protective layer do not emerge to the obverse surface of the recording paper. In this way, the highest glossiness of the recording paper is achieved by use of the same thermal head for smoothing and recording, without lowering coloring quality.

The same effects are obtained by offsetting a center of each heating element in a circumferential direction of a semi-cylindrical glaze layer of the thermal head downstream from a peak of the glaze layer in the first direction. In that case, the contact point of the platen roller with the glaze layer may coincide with the peak of the glaze layer or may be offset from the peak of the glaze layer.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limiting the present invention, wherein like reference numerals designate like or corresponding parts throughout the several views, and wherein.

DETAILED DESCRIPTION OF THE PREFERRED EMBODIMENT

Figure 1:
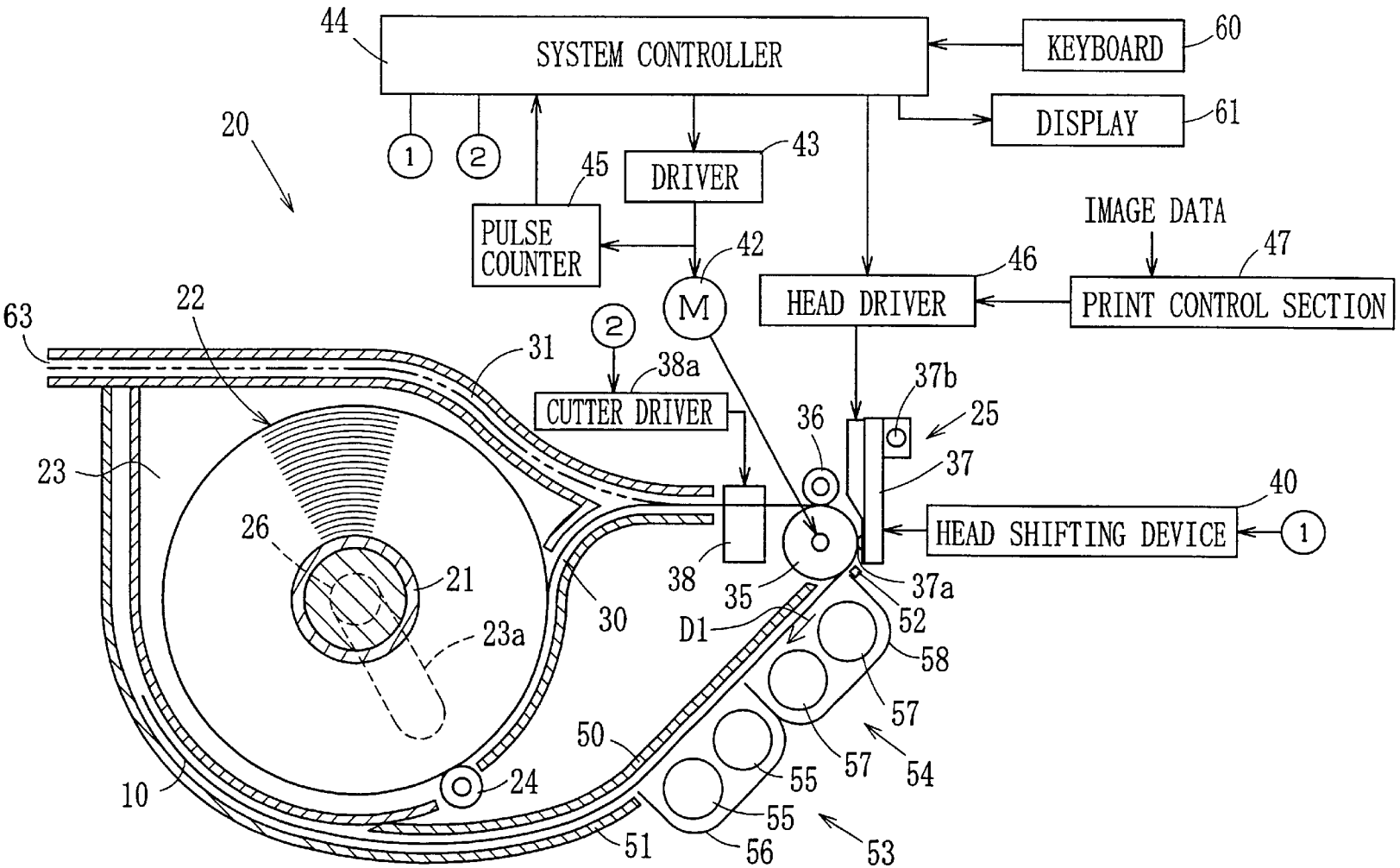
FIG. 1 is a schematic diagram illustrating a platen driven type thermosensitive color printer according to a first embodiment of the invention.
Figure 11:
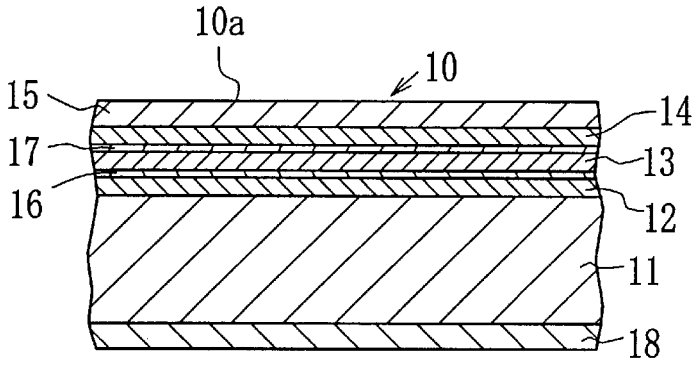
FIG. 11 (PRIOR ART)
FIG. 11 is an explanatory diagram illustrating a layered structure of recording paper.
Figure 12:
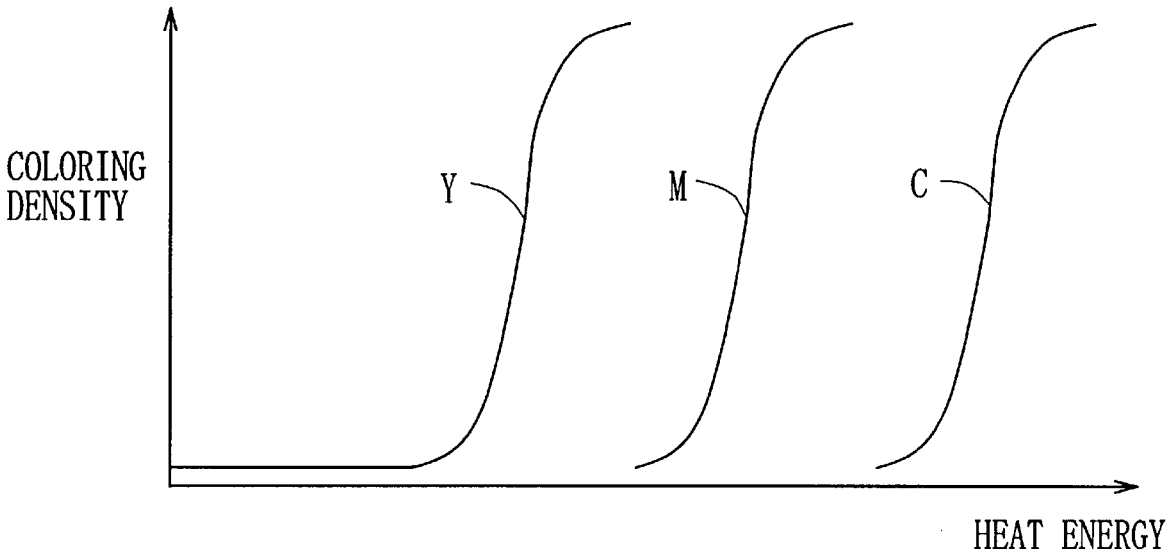
FIG. 12 (PRIOR ART)
FIG. 12 is a graph illustrating coloring characteristics of the recording paper.

In FIG. 1, recording paper 10 having the same structure as shown in FIG. 11 is coiled into a paper roll 22 around a pipe-like spool 21, and a mounting shaft 26 is fitted in the spool 21. The paper roll 22 is loaded in a paper roll chamber 23 of a thermosensitive color printer 20 with the mounting shaft 26 that is engaged in slots 23*a* of the paper roll chamber 23. In the roll chamber 23, the paper roll 22 is urged by a not-shown spring member toward a feed roller 24, so the outermost convolution of the paper roll 22 is always in contact with the feed roller 24 in spite of decreasing diameter of the paper roll 22. As the feed roller 24 rotates, the recording paper 10 is fed out of the paper roll chamber 23 to a printing stage 25 through a paper feed out path 30.

In the printing stage 25, there are a platen roller 35, a nip roller 36 that rotatably contacts the platen roller 35, and a thermal head 37. The nip roller 36 presses the recording paper 10 onto the platen roller 35 before the thermal head 37 in the film feed out direction. The thermal head 37 is mounted pivotal about a mounting shaft 37*b* that extends in parallel to rotational axes of the platen roller 35 and the nip roller 36. Through a head shift device 40, the thermal head 37 is pivotally moved between a recording position where a heating element array 37*a* of the thermal head 37 presses the recording paper 10 onto the platen roller 35, and a rest position where the heating element array 37*a* is off the recording paper 10. When the thermal head 37 is in the recording position, the nip roller 36 and the heating element array 37*a* keep the recording paper 10 being turned tightly around the platen roller 35 through an angle of 90 degrees, so the platen roller 35 can transport the recording paper 10 stably and accurately.

The platen roller 35 is driven to rotate by a pulse motor 42 that is controlled by a system controller 44 through a driver 43. Although it is not shown in the drawing, the pulse motor 42 is also used for rotating the feed roller 24. The pulse motor 42 can rotate in forward and reverse directions. When the pulse motor 42 rotates in the forward direction, the platen roller 35 rotates in a clockwise direction in the drawings, so the recording paper 10 is transported in a printing direction as shown by an arrow D1, that is equal to the paper feed out direction in this embodiment. While the recording paper 10 is transported in the printing direction D1, the thermal head 37 applies heat energy to the recording paper 10 to develop color dots thereon. A pulse counter 45 counts the number of motor drive pulses applied to drive the pulse motor 42, and the system controller 44 determines the position of the recording paper 10. The pulse counter counts up the motor drive pulses while the pulse motor 42 rotates forward, and counts down the motor drive pulses while the pulse motor 42 rotates reversely. By rotating the pulse motor 42 reversely, the platen roller 35 rotates counterclockwise, transporting the recording paper in a returning direction D2 reverse to the printing direction D1.

The thermal head 37 is driven by a head driver 46 under the control of the system controller 44. A print control section 47 sends image data of one frame to the head driver 46 line by line synchronously with the paper transport operation of the platen roller 35, so a color frame is recorded line by line in an image recording area on the recording paper 10. Yellow, magenta and cyan color frames are sequentially recorded in the same image recording area to provide a full-color image.

Along a paper guide 50 that extends behind the platen roller 35 in the printing direction D1, a paper sensor 52, a magenta fixing device 54 and an yellow fixing device 53 are arranged in this order from the platen roller 35. The yellow fixing device 53 consists of a pair of lamps 55 which emit violet visible light having an emission peak at 420 nm, and a reflector 56. The magenta fixing device 54 consists of a pair of lamps 57 which emit ultraviolet rays having an emission peak at 365 nm, and a reflector 58.

A paper guide path 51 is provided behind the yellow fixing device 53 in the printing direction D1, for guiding the recording paper 10 around the paper roll chamber 23 while the following portion of the recording paper 10 in the printing direction D1 is subjected to the optical fixing process by the fixing device 53 or 54. A paper discharge path 31 is provided for guiding the recording paper 10 to a paper exit 63, after a full-color image is recorded and optically fixed on the recording paper 10. A paper cutter 38 is located between the paper discharge path 31 and the platen roller 35. The paper cutter 38 is driven by the system controller 44 through a cutter driver 38*a* to cut the image recording area having the full-color image recorded thereon off the recording paper 10. According to the embodiment of FIG. 1, the paper discharge path 31 and the paper feed out path 30 have a common port on the side of the platen roller 35.

The system controller 44 is a well-known microcomputer, and is provided with a keyboard 60 for entering various commands or the like and a display 61 for displaying the entered commands and selected modes.

Figure 2A:
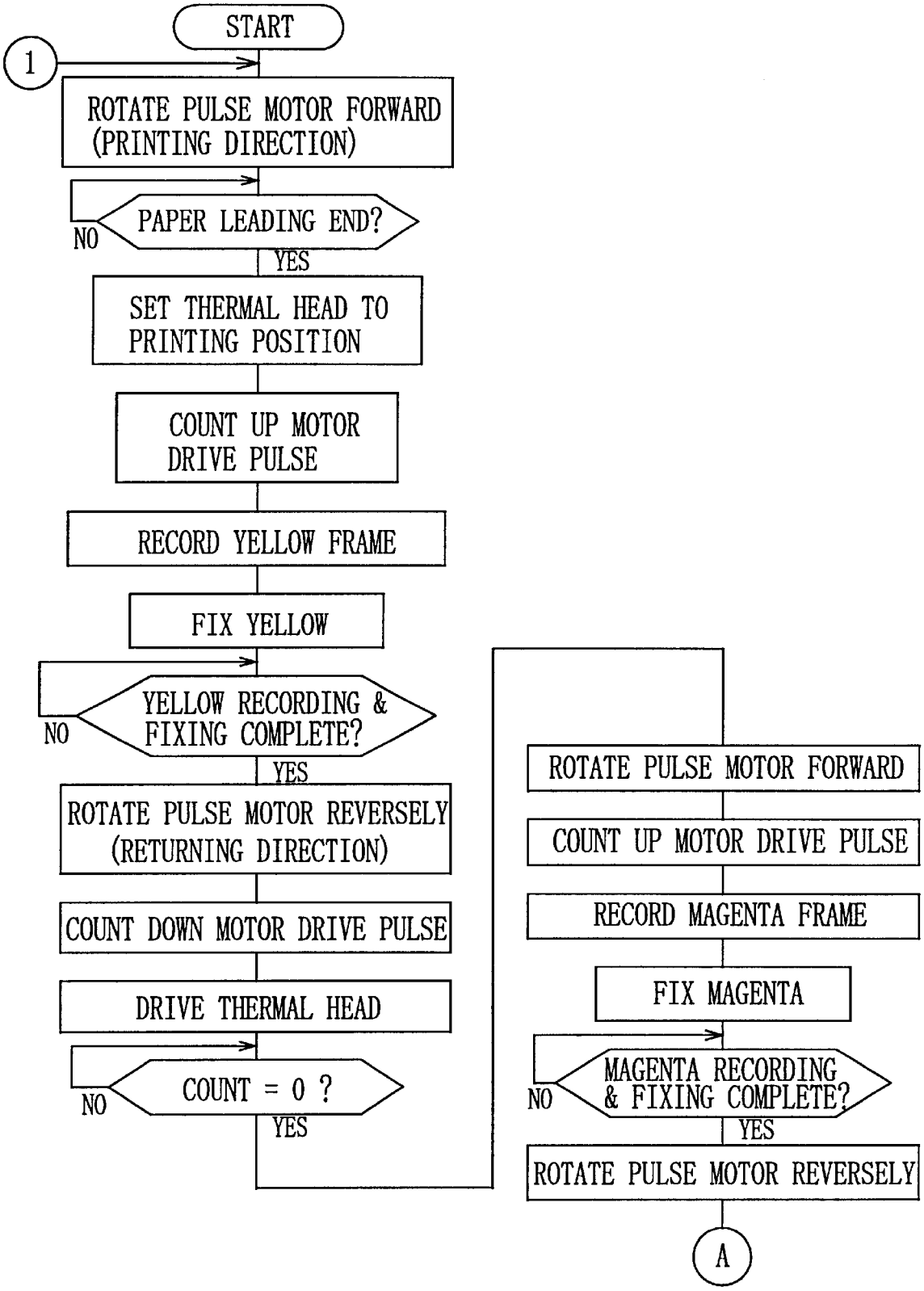
FIGS. 2A and 2B show a flow chart showing the overall operation of the printer of FIG. 1.
Figure 2B:
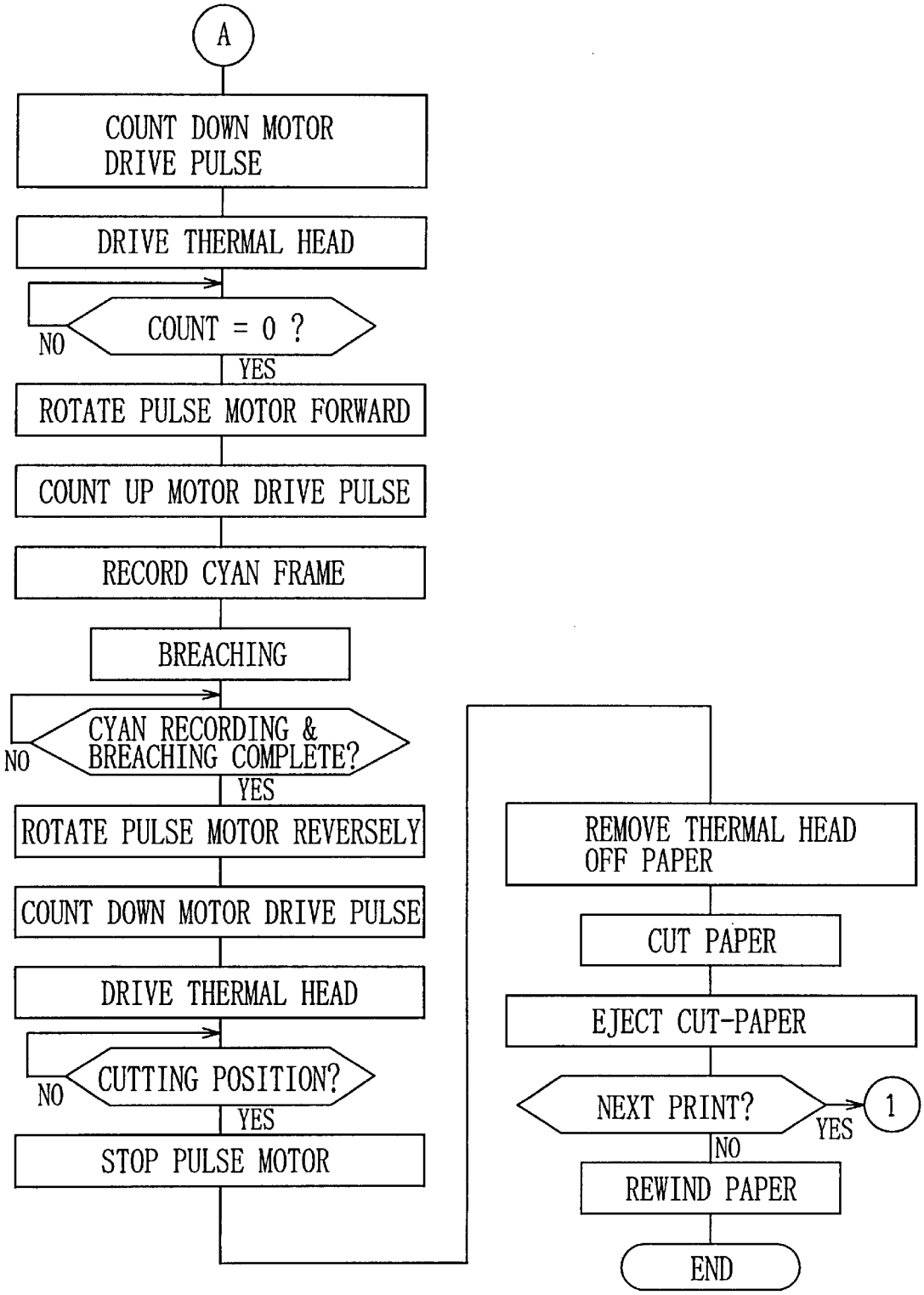

Now, the operation of the thermosensitive color printer 20 will be described with reference to FIGS. 2A and 2B.

The thermal head 37 is initially set at the rest position. When a not-shown print start key of the keyboard 60 is operated, the pulse motor 42 starts rotating forward, so the feed roller 24 as well as the platen roller 35 starts rotating in the clockwise direction, to feed out the recording paper 10 toward the printing stage 25. After a leading end of the recording paper 25 reaches the nip roller 36, the recording paper 10 is nipped between the nip roller 36 and the platen roller 35, and is transported in the printing direction D1. When the paper sensor 52 detects the leading end of the recording paper 10, the head shifting device 40 is driven to set the thermal head 37 to the recording position, pressing the heading element array 37*a* onto the recording paper 10.

Thereafter, the pulse counter 45 counts up the motor drive pulses applied to the pulse motor 42. The system controller 44 determines based on the count of the pulse counter 45 when to start and stop printing each of the three color frames.

The heating element array 37*a* is first driven in accordance with image data of a first line of the yellow frame. Thereby, heat energies of different amounts are applied to the yellow coloring layer 14 to record yellow pixels of different densities in a line in accordance with the image data of the first line. Other lines of the yellow frame are recorded line by line in the same way on an image recording area of the recording paper 10. While the yellow frame is recorded, the lamps 55 of the yellow fixing device 53 are turned on to fix the yellow coloring layer 14.

When the system controller 44 determines based on the count of the pulse counter 45 that the whole image recording area having the yellow frame recorded therein has reached a light projecting area of the yellow fixing device 53, and the yellow coloring layer 14 in the image recording area has been fixed, the system controller 44 stops rotating the pulse motor 42 in the forward direction, and starts rotating it reversely to transport the recording paper 10 in the returning direction D2. Then, the pulse counter 45 counts down the motor drive pulses to the pulse motor 42. When the count comes down to zero, the system controller 44 stops the reverse rotation of the pulse motor 42.

While the recording paper 10 is transported in the returning direction D2, the thermal head 37 is set to the recording position, and is driven to heat the recording paper 10 in the same way as it is heated in the printing direction D1. According to a preferred embodiment, the same image data as used for recording the yellow frame is used for driving the heating element array 37*a* during the transport of the recording paper 10 in the returning direction D2. Thereby, friction factor between the thermal head 37 and the recording paper 10 in the returning direction D2 comes to be approximately equal to that in the printing direction D1.

Accordingly, just by rotating the pulse motor 42 reversely by applying the same number of motor drive pulses as used for rotating the pulse motor 42 in the forward direction from the start of recording the yellow frame to the end of yellow fixing process, the recording paper 10 returns to a print start position relative to the thermal head 37, where the thermal head 37 started recording the first line of the yellow frame. By starting recording the next magenta frame from this position, each line of the magenta frame is located on the corresponding line of the yellow frame. Thus, the color failure is reduced to the minimum.

While the magenta frame is recorded line by line in the same way as the yellow frame, the pulse counter 45 counts up the motor drive pulses applied for transporting the recording paper 10 in the printing direction D1. After the magenta frame is completely recorded and the magenta coloring layer 13 is fixed by the magenta fixing device 54, the pulse motor 42 is driven to rotate reversely so as to return the recording paper 10 to the same print start position.

Also while the recording paper 10 is transported in the returning direction D2 after the magenta frame recording, the thermal head 37 is kept in the recording position, and is driven to heat the recording paper 10 based on the same image data as used for recording the magenta frame. Thereby, the friction factor between the recording paper 10 and the thermal head 37 is maintained substantially unchanged in either transporting direction, so the recording paper 10 stops at the same print start position by stopping the pulse motor 42 at the timing when the pulse counter 45 counts down to zero.

Figure 3:
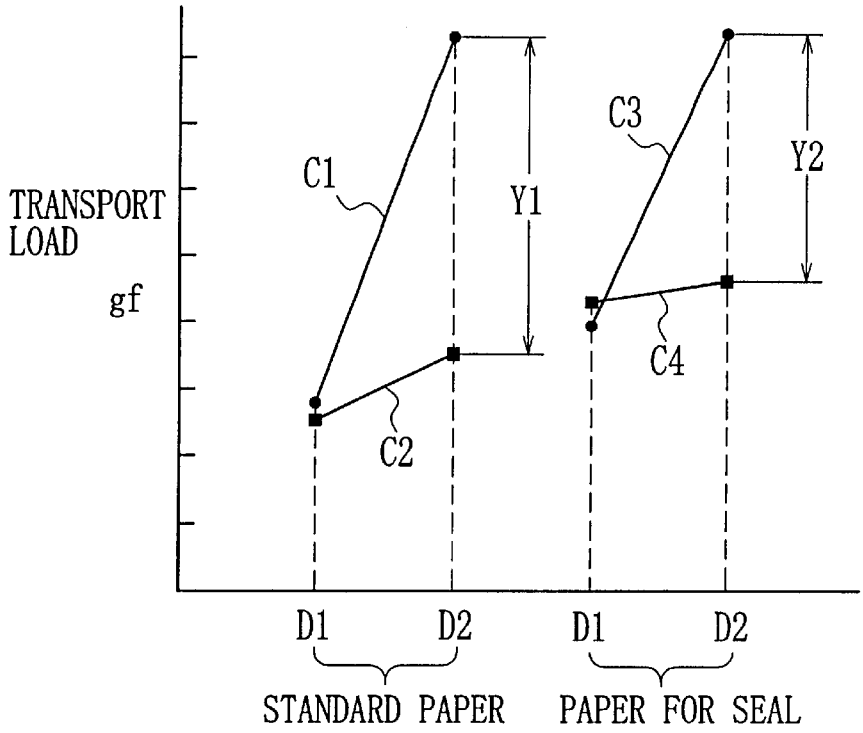
FIG. 3 is a graph showing how the method of the present invention reduces transport load with respect to two types of recording paper.

FIG. 3 shows results of experiments on how the load for transporting recording paper is reduced by heating the recording paper. A curve C1 shows a load required for transporting standard recording paper, having the same or like structure as shown in FIG. 11, in the printing direction D1 while applying heat energy for recording, and a load required for transporting the standard recording paper in the returning direction D2 without heating it. A curve C2 shows a load required for transporting the standard recording paper in the printing direction D1 while applying heat energy for recording, and a load required for transporting the standard recording paper in the returning direction D2 while heating it to the same degree as it is heated in the printing direction D1.

A curve C3 shows a load required for transporting specific recording paper for making seals or stickers while applying heat energy for recording, and a load required for transporting the specific recording paper in the returning direction D2 without heating it. The specific recording paper fundamentally has the same layered structure as shown in FIG. 11, but an adhesive layer is formed on the back layer 18, and a release sheet is attached to cover the adhesive layer, so a hard copy made on the specific recording paper can be used as a seal or a sticker. A curve C4 shows a load required for transporting the specific recording paper in the printing direction D1 while applying heat energy for recording, and a load required for transporting the specific recording paper in the returning direction D2 while heating it to the same degree as it is heated in the printing direction D1.

The curves C1 to C4 show that the load for transporting either type of recording paper is remarkably reduced by heating the recording paper, as indicated by Y1 and Y2, and that the loads for transporting the same type recording paper in the opposite directions come to be substantially equal to each other by heating the recording paper to the same degree in both directions D1 and D2.

It is possible to use other head drive data for heating the recording paper 10 during the returning operation, than the image data used for recording the preceding color frame. As described with respect to the prior art, since irregular fine roughness is provided on the obverse surface 10*a* after a large amount of heat energy is applied to the recording paper 10, it is preferable to drive the heating element array 37*a* to generate the same amount of heat energy so as to heat the whole image recording area of the returning recording paper 10 to the same degree, and thereby to smooth the surface of the image recording area of the recording paper 10. Then, the heating element array 37*a* can uniformly touch the surface of the recording paper 10, and thus the tone reproduction is improved. For example, the same amount of heat energy as necessary for recording yellow pixels at a middle density may be applied to the recording paper 10 during the returning operation after the yellow frame recording. It is possible to calculate the amount of heat energy to be applied per line during the returning operation on the basis of a total amount of heat energy used for recording the yellow frame, such that a total amount of heat energy applied during the returning operation is equivalent to the total amount of heat energy used for recording the yellow frame. Concretely, it is preferable to determine the heat energy per line applied during the returning operation to be equal to an average amount of heat energy used for recording one line of the yellow frame.

The same applies to the paper returning operation after the magenta frame recording. In any case, the amount of heat energy applied to the returning recording paper 10 should be less than a value that has an effect on the next coloring layer to record.

Figure 4:
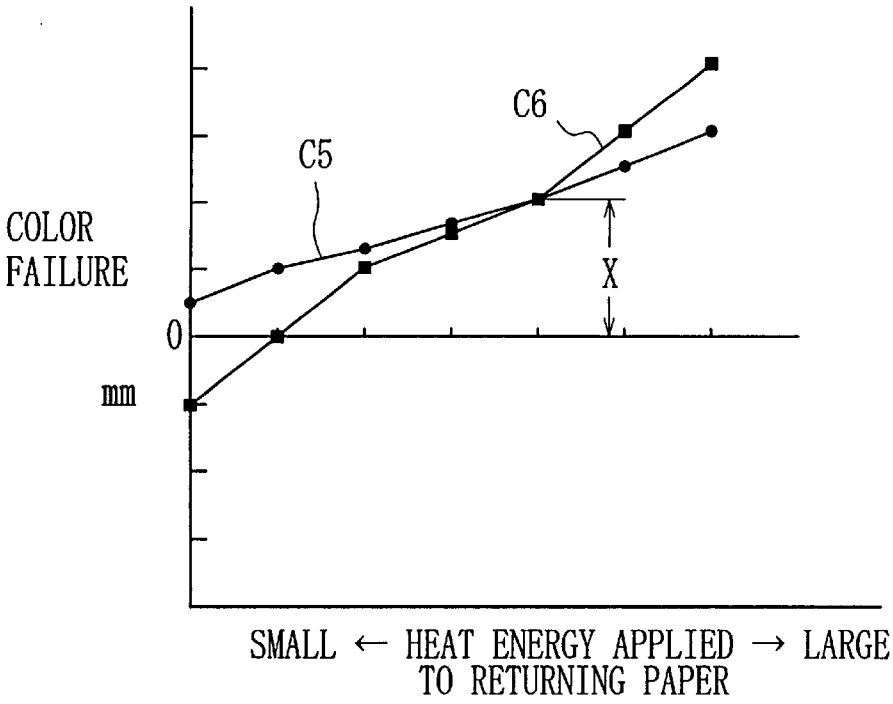
FIG. 4 is a graph showing relationships between color failures on the two types of recording paper and heat energy applied to the recording paper as being returned to a print start position.

FIG. 4 shows results of an experiment on how the color failure is reduced by applying different amounts of heat energy to the recording paper 10 during the paper returning operation. A curve C5 shows a relationship between heat energy applied to the standard recording paper during the paper returning operation, and the amount of color failures, that is, deviation of magenta pixels from yellow pixels at the print start position in this instance. A curve C6 shows a relationship between heat energy applied to the specific recording paper for making seals or stickers during the paper returning operation and color deviations of magenta pixels from yellow pixels at the print start position. The curves C5 and C6 show that the color failures increase if the heat energy is too large.

Where the magenta pixels always deviate from the yellow pixels at the print start position by a constant amount, it is preferable to calculate the number of motor drive pulses necessary for transporting the recording paper by an amount corresponding to that deviation, and correct the number of motor drive pulses for returning the recording paper to the print start position with the calculated number of motor drive pulse that corresponds to the deviation, i.e., by adding or subtracting the calculated number to or from the number of motor drive pulses that is determined based on the count of the pulse counter 45. Thereby, the color failure is eliminated. Similar correction may be done on the number of motor drive pulses for returning the recording paper after the magenta frame recording, thereby to eliminate a color failure between the magenta frame and a cyan frame.

Since the relationship between color failure and heat energy on the standard recording paper differs from that on the specific recording paper, it is preferable to determine the amount of heat energy applied during the returning operation as well as the value for correcting the number of motor drive pulses on the basis of a cross point of these curves C5 and C6. Specifically, it is preferable to drive the pulse motor 42 reversely by the motor drive pulses of a number determined based on a color failure amount X at the cross point, while driving the thermal head 37 to apply the heat energy of the cross point. Thereby, the color failures are well eliminated on either type of recording paper.

When the recording paper 10 is returned to the print start position after the magenta frame recording, the system controller 44 starts driving the pulse motor 42 to rotate forward to transport the recording paper 10 in the printing direction D1, while driving the thermal head 37 to record the cyan frame. The cyan coloring layer 12 is not designed to be optically fixed, so it is not necessary to project light onto the recording paper 10 after the cyan frame recording. However, because those parts of the recording paper 10 having no color developed or no image recorded thereon are breached by being exposed to ultraviolet rays, the lamps 57 of the magenta fixing device 54 are turned on during the cyan frame recording.

After the cyan frame is completely recorded, the pulse motor 42 is rotated reversely to transport the recording paper 10 in the returning direction D2. Also while the recording paper 10 is transported in the returning direction D2 after the cyan frame recording, the thermal head 37 is pressed onto the recording paper 10 to heat the recording paper 10 up to a uniform degree. This is not for reducing the color failure because the three color frames have been recorded. This is for smoothing the surface of the protective layer 15 of the recording paper 10.

By this smoothing process, the glossiness of the recording paper 10 is restored, and also it becomes easier to accurately position the recording paper 10 at a predetermined cutting position relative to the paper cutter 38 just by controlling start and stop of the pulse motor 42 with reference to the count of the pulse counter 45. When the recording paper 10 is positioned at the cutting position in this way, the paper cutter 38 is activated to cut the image recording area having the full-color image recorded thereon off the other portion of the recording paper 10. The cut piece of recording paper 10 is transported through the paper discharge path 31 to the paper exit 63 by use of not-shown paper ejection rollers. To print the next image, the pulse motor 42 is rotated forward to transport a new leading end of the recording paper 10 to the printing stage 25, and the same processes as above are executed. When the printer 20 is deactivated, the leading end of the recording paper 10 is rewound into the paper roll chamber 23 by rotating the pulse motor 42 reversely.

To smooth the recording paper 10, it is necessary to heat the protective layer 15 up above its glass transit temperature and soften the protective layer 15. As described above, the glass transit temperature of the protective layer 15 is dependent upon its components. According to this embodiment, the protective layer 15 uses PVA (poly-vinyl-alcohol) as the main component whose glass transit temperature is about 70° C. This is below the lowest heat energy necessary for recording a dot with the lowest coloring density on the highest sensitive coloring layer of the color recording paper 10, i.e. the yellow coloring layer 14 in this instance. Because the cyan coloring layer 12 is not fixed, the heat energy for the smoothing must be smaller than a value which causes the cyan coloring layer 12 to start coloring.

To control the heat energy applied to the recording paper 10 with accuracy, it is necessary to consider heat accumulation in the thermal head 37. If the pulse duty factor of head drive pulses for driving the thermal head 37, i.e. pulse width per line recording cycle, is too large, the heat accumulation adversely affects the temperature control and results variations in glossiness. If the pulse duty factor is too small and the recording paper 10 is cooled too long, some parts of the protective layer 15 would not be softened so that the obverse surface 10*a* is provided with fine regular undulation at intervals of 1 $\mu$m to 2 $\mu$m because of the difference between softened and not-softened portions. This undulation is detected by organoleptic or sensory tests, and deteriorates the print quality. According to experiments, the pulse duty factor is best at 70% for smoothing.

Figure 5A:
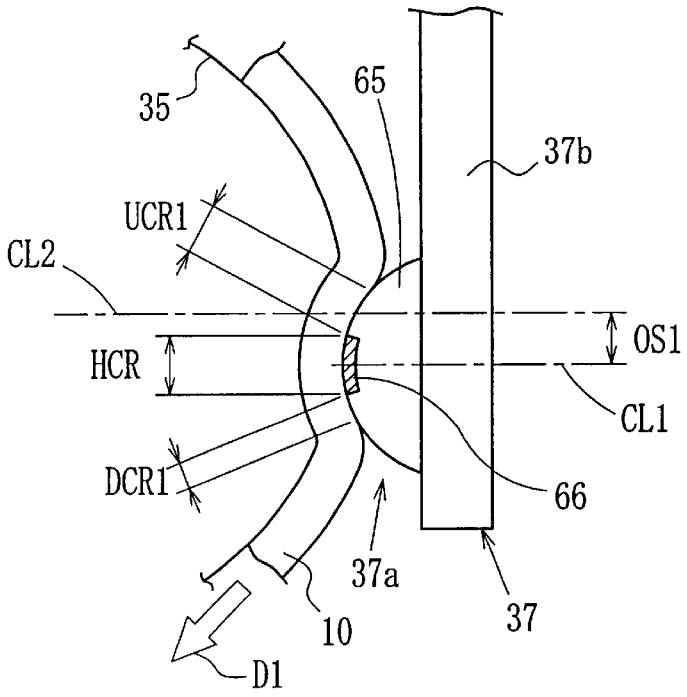
FIG. 5A is an explanatory diagram illustrating a relationship between a thermal head and a platen roller and the recording paper during a recording process where the recording paper is transported in a printing direction.
Figure 5B:
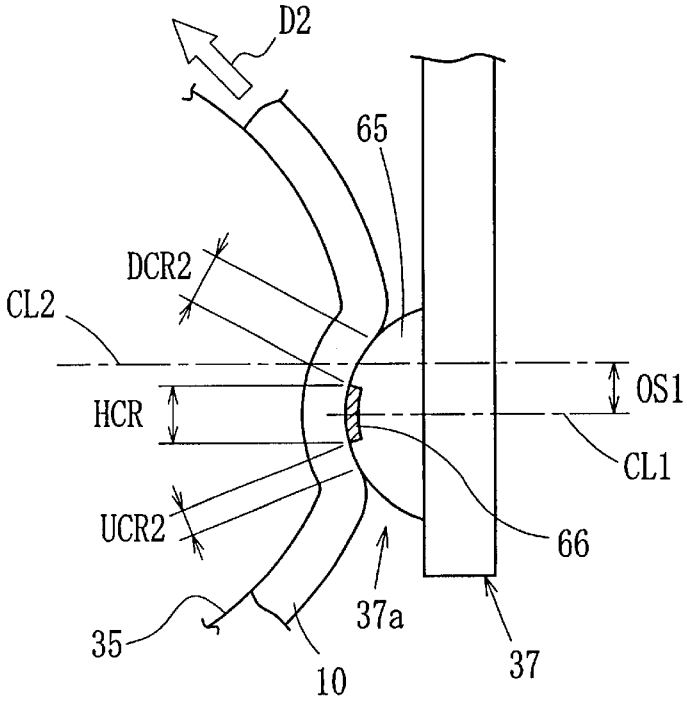
FIG. 5B is an explanatory diagram illustrating a relationship between the thermal head and the platen roller and the recording paper during a smoothing process where the recording paper is transported in a returning direction reverse to the printing direction.

As shown in FIGS. 5A and 5B, the heating element array 37*a* of the thermal head 37 is formed on a substrate 37*b*, and consists of a glaze layer 65 that has a semi-cylindrical shape whose axis extends in the crosswise direction of the recording paper 10, and a large number of heating elements 66 arranged on a peak line of the glaze layer 65. According to this embodiment, the center CL1 of each heating element 66 in the circumferential direction of the glaze layer 65 coincides with the peak or center of the glaze layer 65, wherein the circumferential direction of the glaze layer 65 is substantially parallel to the transporting directions of the recording paper 10. A center line CL2 of the platen roller 35 that extends across the rotational center of the platen roller 35 in a perpendicular direction to the substrate 37*b* is offset from the center CL1 of the heating element 66 by an amount OS1 upstream in the printing direction D1. Thereby, a contact point between the platen roller 35 and the glaze layer 65 is offset from the peak of the glaze layer 65, i.e., from the center CL1 of the heating elements 66.

In FIGS. 5A and 5B, "HCR" represents a contact range where the recording paper 10 contacts the heating elements 66, "UCR1" and "UCR2" represent upstream contact ranges where the recording paper 10 contacts the glaze layer 65 before it contacts the heating element 66, and "DCR1" and "DCR2" represent downstream contact ranges where the recording paper 10 contacts the glaze layer 65 after it contacts the heating element 66. Because of the offset amount OS1 of the center CL1 of the heating elements 66 from the center line CL2 of the platen roller 35, the downstream contact range DCR1 is shorter than the upstream contact range UCR1 in the printing direction D1, as shown in FIG. 5A. Accordingly, the recording paper 10 is not so rapidly cooled by the glaze layer 66 after being heated for recording. This is effective to eliminate unexpected variations in coloring density that would be caused if the recording paper 10 is rapidly cooled after the recording.

In the returning direction D2, on the contrary, the downstream contact range DCR2 is longer than the upstream contact range UCR2, as shown in FIG. 5B, because of the offset OSI of the center CL1 from the center line CL2. Accordingly, the recording paper 10 after being heated for smoothing is rapidly cooled by the glaze layer 66 and the temperature of the protective layer 15 rapidly lowers below its glass transit point till its removes off the glaze layer 15. So the additives contained in the protective layer 15 are prevented from emerging to the obverse surface 10*a* after the smoothing process. Therefore, the glossiness of the recording paper 10 is improved.

Figure 6:
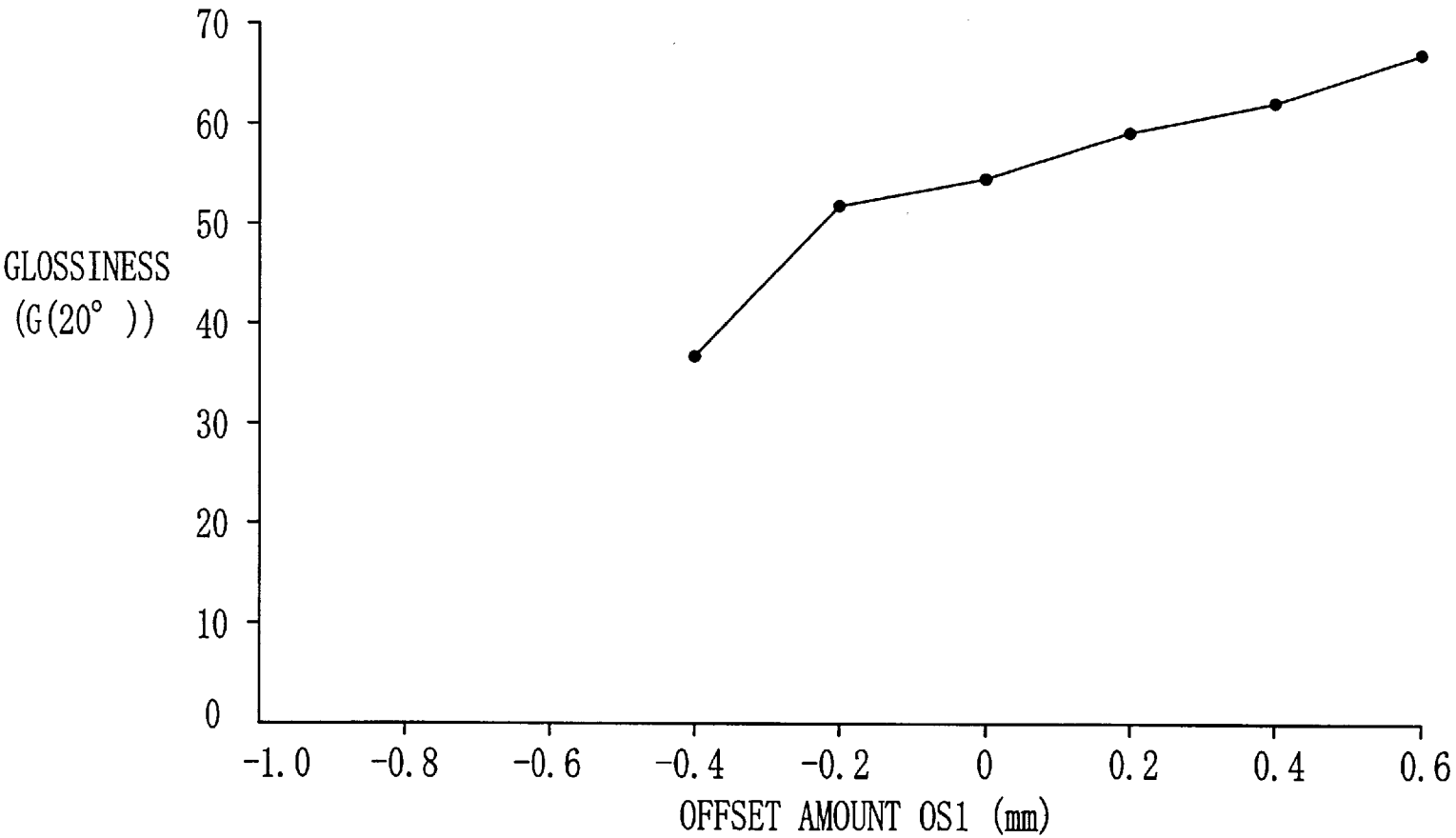
FIG. 6 is a graph illustrating a relationship between glossiness of the recording paper and offset amount of the thermal head, relative to the platen roller.

FIG. 6 shows a relationship between glossiness of the recording paper 10 and the offset amount OS1, wherein G(20°) indicates that incident angle is set at 20° according to JIS standards. In the horizontal axis showing the offset amount OS1, negative values means that the center CL1 of the heating elements 66 is offset downstream from the center line CL2 in the returning direction D2 of the recording paper 10, whereas positive values represent that the center CL1 is offset upstream from the center line CL2 in the returning direction D2. As seen from the graph of shown FIG. 6, the glossiness is improved by offsetting the heating elements 66 to the upstream side of the center line CL2 of the platen roller 35 in the returning direction D2, that is, by offsetting the contact point of the platen roller 35 with the glaze layer 65 upstream from the center CL1 of the heating elements 66.

Figure 7:
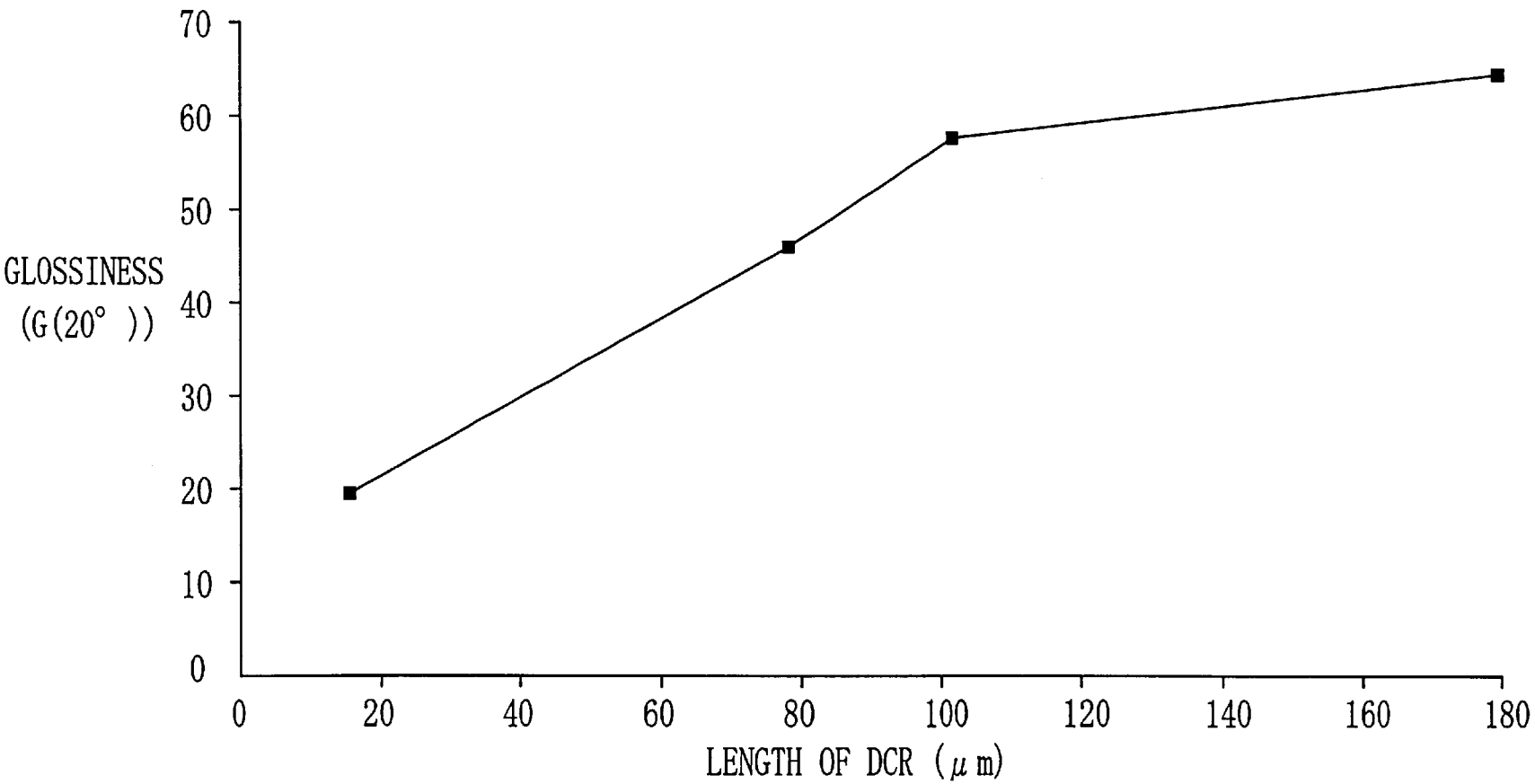
FIG. 7 is a graph illustrating a relationship between glossiness of the recording paper and contact length of the recording paper with a glaze layer of the thermal head after contacting with a heating element.

FIG. 7 shows a relationship between glossiness of the recording paper 10 and the length of the downstream contacting range DCR2 in the returning direction D2, wherein the glossiness is improved as the downstream contacting range DCR2 gets longer.

Figure 8:
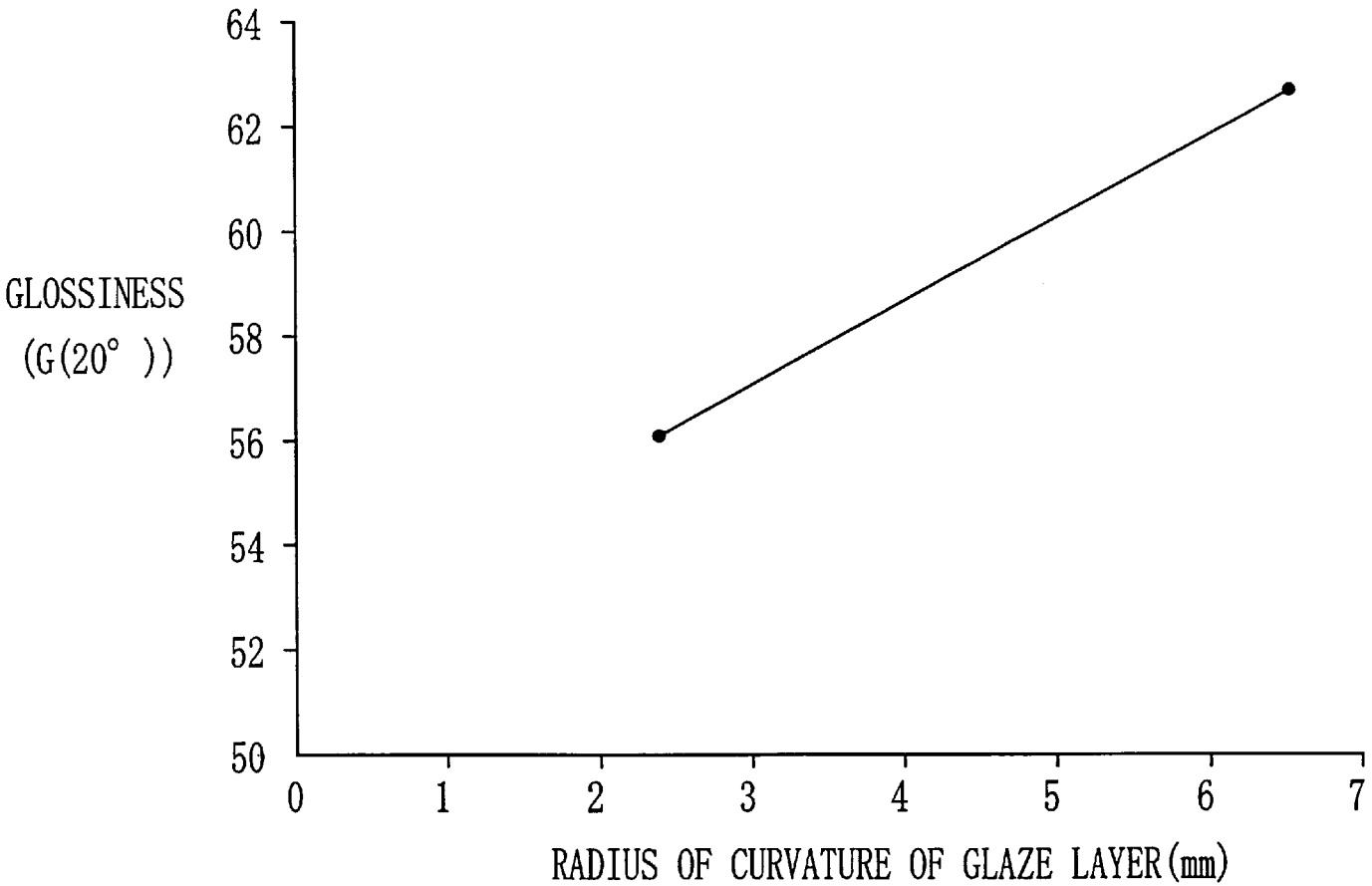
FIG. 8 is a graph illustrating a relationship between glossiness of the recording paper and radius of curvature of the glaze layer.

FIG. 8 shows a relationship between glossiness of the recording paper 10 and radius of curvature of the glaze layer 65, wherein the glossiness is improved as the radius of curvature increases. According to experiments, the smaller radius of curvature of the glaze layer 65 is preferable in order to reduce unexpected density variations in the printed image. Therefore, an optimum radius of curvature of the glaze layer 65 for either purpose is to be determined by experiments.

Figure 9A:
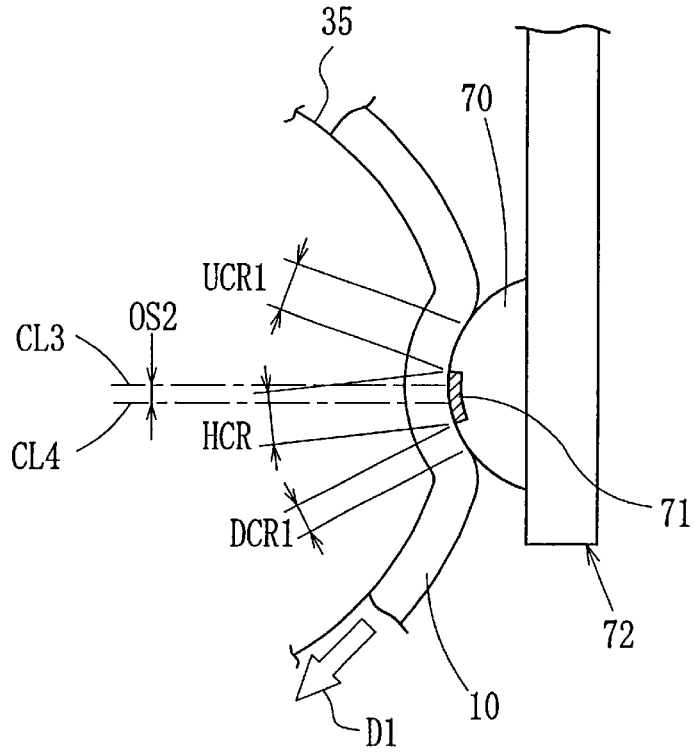
FIG. 9A is an explanatory diagram illustrating a relationship between a thermal head of a second embodiment and the platen roller and the recording paper during the recording process.
Figure 9B:
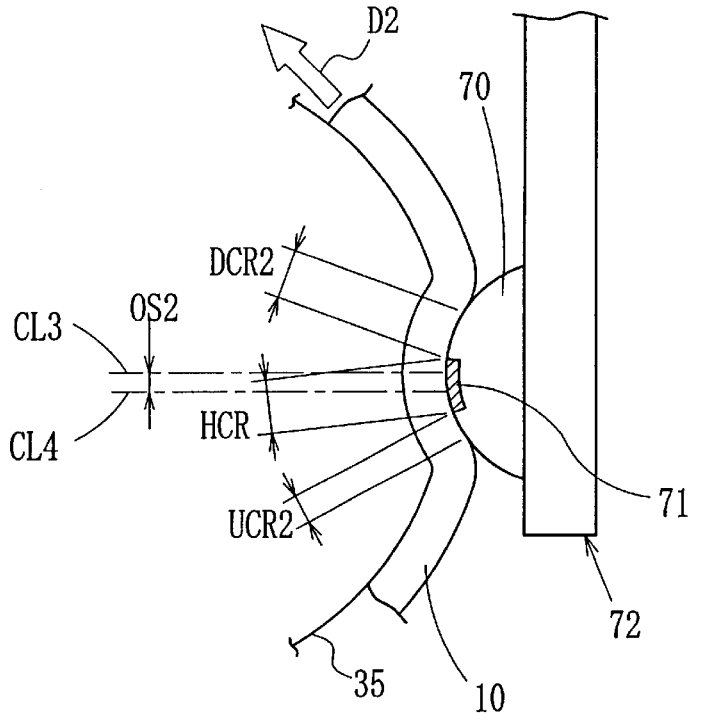
FIG. 9B is an explanatory diagram illustrating a relationship between the thermal head of the second embodiment and the platen roller and the recording paper during the smoothing process.

Although the center CL1 of the heating element 66 that coincides the peak of the glaze layer 65 is offset from the center CL2 of the platen roller 35 in FIGS. 5A and 5B, according to another embodiment shown in FIGS. 9A and 9B, the same effect is obtained by offsetting a center CL4 of heating elements 71 upstream from a peak or center CL3 of a glaze layer 70 in the returning direction D2. In the embodiment shown in FIGS. 9A and 9B, the center line CL3 of the glaze layer 70 may coincide with the center line CL2 of the platen roller 35 or may be offset upstream from the center line CL2 in the returning direction D2, like as shown in FIGS. 5A and 5B.

In the above embodiment, the recording paper 10 is transported in the printing direction D1 by rotating the pulse motor 42 forward, and in the returning direction D2 by rotating the pulse motor 42 reversely. It is possible to provide a reverse gear mechanism in a power transmission mechanism from the pulse motor 42 to the platen roller 35 such that the platen roller 35 is alternatively rotated in opposite directions by rotating the pulse motor 42 only in one direction. Instead of determining the transport length of the recording paper 10 with reference to the count of the pulse counter 45 that counts the motor drive pulses to the pulse motor 42, it is possible to determine the paper transport length on the basis of control signal from the system controller 44.

Figure 10:
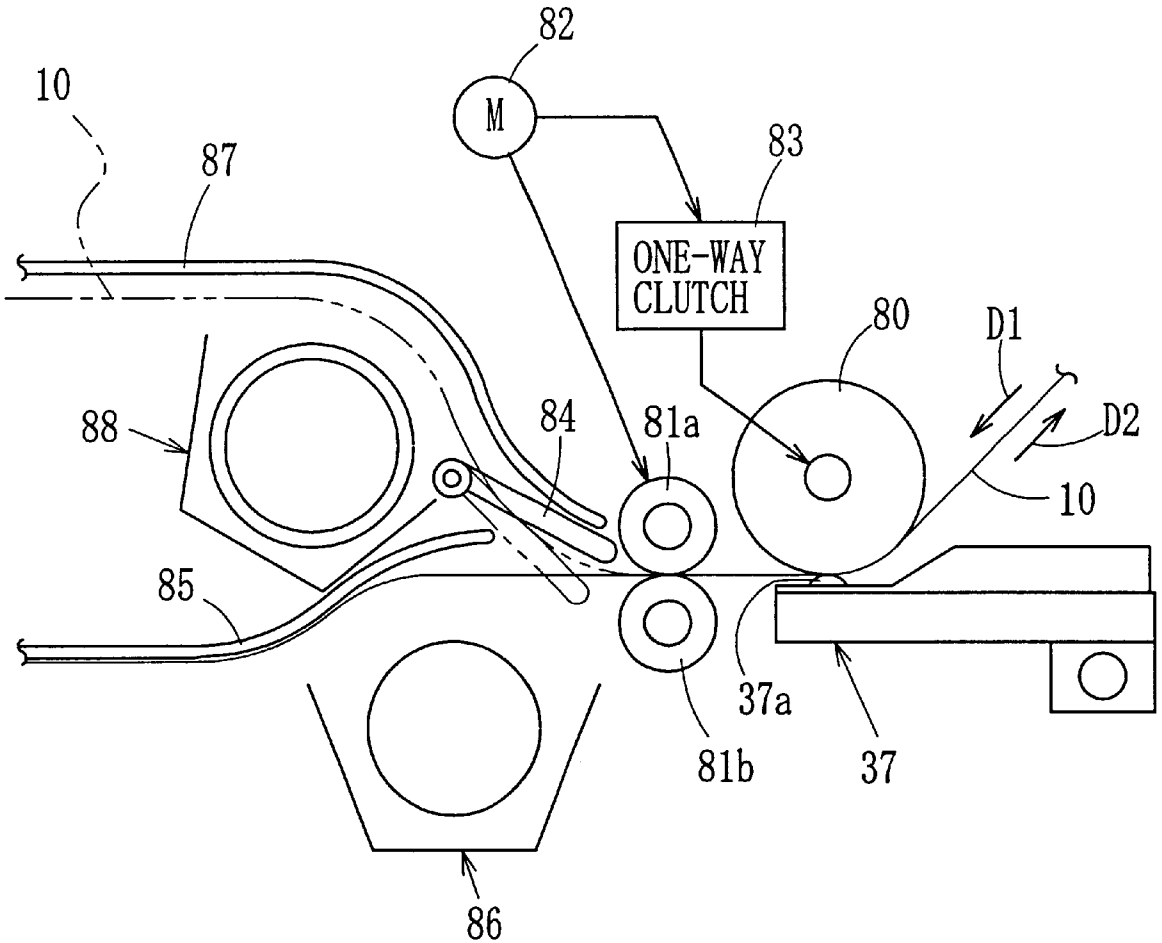
FIG. 10 is a schematic diagram illustrating a capstan driven type thermosensitive color printer according to a third embodiment of the invention.

Although the present invention has been described with respect to the platen-driven type thermosensitive color printer 20, the present invention is of course applicable to a capstan-driven type thermosensitive color printer. FIG. 10 shows an embodiment of capstan-driven type printer, wherein a pair of feed rollers, i.e., a capstan roller 81*a* and a pinch roller 81*b* are disposed at a downstream position of a platen roller 80 in a printing direction D1. The capstan roller 71*a* is rotated by a pulse motor 82, such that recording paper 10 is transported in the printing direction D1 while the pulse motor 82 rotates forward, and in a returning direction D2 while the pulse motor 82 rotates reversely. The pulse motor 82 is coupled to the platen roller 80 through a one-way clutch 83, such that only the reverse rotation of the pulse motor 82 is transmitted to the platen roller 70.

Accordingly, the platen roller 80 rotates freely while the recording paper 10 is transported in the printing direction D1 only by the feed rollers 81*a* and 81*b*. The recording paper 10 is transported in the returning direction D2 by the feed rollers 81*a* and 81*b* and the platen roller 80 as well. It is possible to replace the one-way clutch 83 with an electromagnetic clutch to disconnect the pulse motor 82 from the platen roller 80 while the recording paper 10 is transported in the printing direction D1.

According to the embodiment shown in FIG. 10, a switching guide member 84 is provided in a downstream position of the feed rollers 81*a* and 81*b* in the printing direction D1. The switching guide member 84 moves upward to guide the recording paper 10 to a yellow fixing device 86 along a yellow fixing guide 85, while the yellow frame is recorded. The switching guide member 84 moves downward to guide the recording paper 10 to a magenta fixing device 88 along a magenta fixing guide 87, while the magenta frame is recorded. Since the yellow and magenta fixing devices 86 and 88 are located near the feed rollers 81*a* and 81*b*, the recording paper 10 needs to be transported less amount for the fixing compared to a case where yellow and magenta fixing devices are arranged side by side along a paper transport path, like as shown in FIG. 1. But it is possible to arrange the fixing devices 86 and 88 side by side along a paper transport path. It is also possible to use an inverting device that alternately puts either of yellow and magenta fixing devices in face of the recording paper, wherein the fixing devices are rotationally symmetric to each other and rotatable about the point of symmetry.

The present invention is applicable to those printers which uses cut sheets of recording paper instead of the continuous web of recording paper that is withdrawn from a paper roll.

It is possible to rotate the platen roller 35 or 80 or the capstan roller 81*a* by a DC motor in place of the pulse motor 35 or 82. In that case, it is possible to provide a pulse encoder on an axle of the platen roller to generate encode pulses representative of the number of rotations of the platen roller, and control the DC motor based on the count of the encode pulses.

In the embodiment shown in FIG. 1, the nip roller 36 is used for enlarging the winding angle of the recording paper 10 around the platen roller 35 and thus enforcing the transporting power of the platen roller 35. The nip roller 36 may be omitted, or a second nip roller may be provided behind the thermal head 37 in the printing direction D1 to obtain larger winding angle and transporting power.

Although the heating elements 66 or 71 of the thermal head 37 or 72 are designed to have an equal resistance value, the resistance values of some heating elements can slightly differ from the designed value. Therefore, it is desirable to correct not only the image data but also the head driving data for the smoothing in accordance with the variations in resistance values of the heating elements so as to generate a constant amount of heat energy for the smoothing.

As well-known in the art, heat energy is accumulated with time in the thermal head, and the accumulated heat energy adversely affects the amount of heat energy applied to the recording paper. So it is desirable to correct the head driving data for the smoothing as well as the image data so as to eliminate the influence of the accumulated heat energy. Since the heat accumulation is dependent on the position of the heating elements in the array, it is useful to correct the head drive data in accordance with the position of the heating elements.

It is possible to fix the yellow or magenta coloring layer while the recording paper is transported in the returning direction D2. It is also possible to effect the fixing process in the opposite directions D1 and D2. The position of the yellow fixing device and the magenta fixing device may be changed with each other.

Thus, the present invention is not to be limited to the above embodiments but, on the contrary, various modifications may be possible to those skilled in the art without departing from the scope of claims appended hereto.

What is claimed is:

1. A thermosensitive color printing method of printing a full-color image in a frame sequential fashion on thermosensitive color recording paper having first, second and third coloring layers formed on atop another on one side of a base material in this order from an obverse surface, the first to third coloring layers developing different colors from each other, and having decreasing heat-sensitivities from the first to the third, the method comprising the steps of:

A. pressing the thermosensitive color recording paper onto the thermal head by a platen roller;

B. transporting the thermosensitive color recording paper in a first direction;

C. driving a thermal head during step B, to record a first color frame on the first coloring layer;

D. projecting electromagnetic rays of a specific wavelength range onto the thermosensitive recording paper to fix the first coloring layer after having the first color frame recorded thereon;

E. transporting the thermosensitive color recording paper in a second direction reverse to the first direction after the first color frame is completely recorded, till the thermosensitive color recording paper is returned to a print start position where the thermal head started recording the first color frame;

F. driving the thermal h e ad during step E, to heat the thermosensitive color recording paper to an extent that the second and third coloring layers do not develop color, thereby to make friction factor between the thermal head and the recording paper as equal as possible in the first and second directions;

G. transporting the thermosensitive color recording paper in the first direction after the thermosensitive color recording paper reaches the print start position;

H. driving the thermal head during step G, to record a second color frame on the second coloring layer;

I. projecting electromagnetic rays of a specific wavelength range onto the thermosensitive recording paper to fix the second coloring layer after having the second color frame recorded thereon;

J. transporting the thermosensitive color recording paper in the second direction after the second color frame is completely recorded, till the thermosensitive color recording paper is returned to the print start position;

K. driving the thermal head during step J, to heat the thermosensitive color recording paper to an extent that the third coloring layer does not develop color, thereby to make friction factor between the thermal head and the recording paper as equal as possible in steps G and J;

L. transporting the thermosensitive color recording paper in the first direction after the thermosensitive color recording paper reaches the print start position; and M. driving the thermal head during step L, to record a third color frame on the third coloring layer.

2. A thermosensitive color printing method as claimed in claim 1, wherein the thermal head is driven in step F or K on the basis of image data used for driving the thermal head in step C or H respectively.

3. A thermosensitive color printing method as claimed in claim 2, wherein all heating elements of the thermal head are equally heated in step F or K such that a total amount of heat energy applied during step F or K is equivalent to a total amount of heat energy applied during step C or H respectively.

4. A thermosensitive color printing method as claimed in claim 1, further comprising the step of correcting the transported amount of the thermosensitive color recording paper in the second direction so as to stop the thermosensitive color recording paper precisely at the print start position.

5. A thermosensitive color printing method as claimed in claim 1, further comprising the steps of:

generating pulses that represent rotational amounts of the platen roller; and detecting position of the thermosensitive color recording paper relative to the thermal head by counting up or down the pulses while the thermosensitive color recording paper is transported in the first direction or the second direction respectively.

6. A thermosensitive color printing method as claimed in claim 1, further comprising the steps of:

N. transporting the thermosensitive color recording paper in the second direction after the third color frame is completely recorded; and O. driving the thermal head to heat the thermosensitive color recording paper during step N to an extent that the third coloring layer does not develop color, to smooth a transparent plastic protective layer that is formed on the first coloring layer to coat the obverse surface of the thermosensitive color recording paper.

7. A thermosensitive color printing method as claimed in claim 6, wherein, in step O, all the heating elements of the thermal head are equally heated up above a glass transit temperature of the protective layer but below a temperature above which the third coloring layer starts coloring.

8. A thermosensitive color printing method of printing a full-color image in a frame sequential fashion on thermosensitive color recording paper having first, second and third coloring layers formed on atop another on one side of a base material in this order from an obverse surface and a transparent plastic protective layer formed on the first coloring layer to coat the obverse surface of the thermosensitive color recording paper, the first to third coloring layers developing different colors from each other, and having decreasing heat-sensitivities from the first to the third, the method comprising the steps of:

A. pressing the thermosensitive color recording paper onto the thermal head by a platen roller;

B. transporting the thermosensitive color recording paper in a first direction;

C. driving a thermal head to record a first color frame on the first coloring layer during step B;

D. projecting electromagnetic rays of a specific wavelength range onto the thermosensitive recording paper to fix the first coloring layer after having the first color frame recorded thereon;

E. transporting the thermosensitive color recording paper in a second direction reverse to the first direction after the first color frame is completely recorded, till the thermosensitive color recording paper is returned to a print start position where the thermal head started recording the first color frame;

F. transporting the thermosensitive color recording paper in the first direction after the thermosensitive color recording paper reaches the print start position;

G. driving the thermal head to record a second color frame on the second coloring layer during step F;

H. projecting electromagnetic rays of a specific wavelength range onto the thermosensitive recording paper to fix the second coloring layer after having the second color frame recorded thereon;

I. transporting the thermosensitive color recording paper in the second direction after the second color frame is completely recorded till the thermosensitive color recording paper is returned to the print start position;

J. transporting the thermosensitive color recording paper in the first direction after the thermosensitive color recording paper reaches the print start position;

K. driving the thermal head to record a third color frame on the third coloring layer during step J;

L. transporting the thermosensitive color recording paper in the second direction after the third color frame is completely recorded; and M. driving the thermal head to heat the thermosensitive color recording paper during step K to an extent that the third coloring layer does not develop color, to smooth the protective layer.

9. A thermosensitive color printing method as claimed in claim 8, wherein, in step M, all the heating elements of the thermal head are equally heated up above a glass transit temperature of the protective layer but below a temperature above which the third coloring layer starts coloring.

10. A thermosensitive color printer for printing a full-color image in a frame sequential fashion on thermosensitive color recording paper having first, second and third coloring layers formed on atop another on one side of a base material in this order from an obverse surface, the first to third coloring layers developing different colors from each other, and having decreasing heat-sensitivities from the first to the third, the thermosensitive color printer comprising:

a thermal head having a plurality of heating elements arranged in an array;

a platen roller located in opposition to the heating elements of the thermal head so as to press the thermosensitive color recording paper onto the heating elements;

a paper transporting device for transporting the thermosensitive color recording paper through between the thermal head and the platen roller in a first direction perpendicular to the array of the heating elements, and alternately in a second direction reverse to the first direction, the paper transporting device transporting the thermosensitive color recording paper three times in either direction per one full-color image;

a head driving device for driving the thermal head, the head driving device drives the thermal head based on image data to record first, second and third color frames sequentially from the first to third on the first to third coloring layers while the thermosensitive color recording paper is transported in the first direction for the first time, for the second time and for the third time; and a first optical fixing device disposed downstream from the thermal head in the first direction, for fixing the first coloring layer after the first frame is recorded thereon; and a second optical fixing device disposed downstream from the thermal head in the first direction, for fixing the second coloring layer after the second frame is recorded thereon;

wherein the head driving device drives the thermal head also while the thermosensitive color recording paper is transported in the second direction, to heat the thermosensitive color recording paper to an extent that does not have an effect on those coloring layers which are not fixed.

11. A thermosensitive color printer as claimed in claim 10, wherein the head driving device drives the thermal head while the thermosensitive color recording paper is transported in the second direction on the basis of image data used for driving the thermal head to record the first or second color frame respectively after the first or the second color frame is recorded.

12. A thermosensitive color printer as claimed in claim 10, wherein while the thermosensitive color recording paper is transported in the second direction after the third color frame is recorded, the head driving device drives the thermal head to heat the thermosensitive color recording paper uniformly to an extent that the third coloring layer does not develop color.

13. A thermosensitive color printer as claimed in claim 10, wherein the array of heating elements is formed along a peak of a semi-cylindrical glaze layer, whereas a contact point of the platen roller with the glaze layer is offset upstream from a center of each heating element in the first direction.

14. A thermosensitive color printer as claimed in claim 13, wherein the center of each heating element is offset downstream from the peak of the glaze layer in the first direction.

15. A thermosensitive color printer as claimed in claim 8, wherein the paper transporting device comprises the platen roller, at least a nip roller for pressing the thermosensitive color recording paper onto the platen roller, and a motor for rotating the platen roller in opposite directions, wherein the thermosensitive color recording paper is turned around the platen roller.

16. A thermosensitive color printer as claimed in claim 8, wherein the paper transporting device comprises a pair of feed rollers that pinch the thermosensitive color recording paper, a motor coupled to one of the feed rollers to rotate the feed rollers in opposite directions, and a clutch member that connects the motor to the platen roller while the feed rollers rotate to transport the thermosensitive color recording paper in the second direction and disconnects the motor from the platen roller while the feed rollers rotate to transport the thermosensitive color recording paper in the first direction.

17. A thermosensitive color printer as claimed in claim 8, further comprising a switching guide member for guiding the thermosensitive color recording paper either to the first optical fixing device or to the second optical fixing device respectively after the first color frame or the second color frame are recorded on the thermosensitive color recording paper.

* * * * *